United States Patent [19]

Hankinson, Jr.

[11] Patent Number: 4,700,642

[45] Date of Patent: Oct. 20, 1987

[54] JOINING CONTINUOUS LENGTHS OF WEB MATERIALS

[75] Inventor: Julian E. Hankinson, Jr., Spartanburg, S.C.

[73] Assignee: Young Engineering Inc., Spartanburg, S.C.

[21] Appl. No.: 726,769

[22] Filed: Apr. 24, 1985

[51] Int. Cl.[4] ..... D05B 3/00; B65H 19/16

[52] U.S. Cl. ..... 112/121.14; 112/262.3; 242/58.1; 242/58.4

[58] Field of Search ..... 112/2, 2.1, 121.14, 112/121.12, 121.15, 7, 8, 10, 9, 130; 242/58.1, 58.4

[56] References Cited

U.S. PATENT DOCUMENTS

| | | | |
|---|---|---|---|
| 2,163,304 | 6/1939 | Corrall et al. | 112/7 X |
| 2,593,196 | 4/1952 | Rotherham | 112/121.14 |
| 2,724,352 | 11/1955 | Gentry et al. | 112/121.14 |
| 2,836,133 | 5/1958 | Gamble et al. | 112/121.14 |
| 2,836,135 | 5/1958 | Briggs | 112/315 |
| 3,009,428 | 11/1961 | Coolidge | 112/121.14 |
| 3,167,041 | 1/1965 | Briggs | 112/121.14 |
| 3,396,686 | 8/1968 | Davidson et al. | 112/121.14 |
| 3,515,081 | 6/1970 | Miller | 112/130 |
| 4,457,243 | 7/1984 | Bowditch | 112/121.14 |
| 4,470,361 | 9/1984 | Smith | 112/121.14 |

*Primary Examiner*—H. Hampton Hunter
*Attorney, Agent, or Firm*—Dority & Manning

[57] ABSTRACT

Two lengths of discrete web materials are automatically joined by suitable alignment and positioning of their respective leading and trailing web edges. Transverse movement of such edges is automatically controlled so that longitudinal margins of such edges are aligned, also. Once a first roll of material is emptied and its trailing edge is joined with a leading edge of a new roll of material, support structure for the new roll is pivoted so that the new roll is physically moved into the support and drive position previously occupied by the old roll.

10 Claims, 13 Drawing Figures

JOINING CONTINUOUS LENGTHS OF WEB MATERIALS

BACKGROUND OF THE INVENTION

The present invention relates to apparatus and method for automatically uniting two discrete lengths of web such as woven or knitted fabrics.

Heretofore, numerous types of equipment and techniques have been employed for joining two discrete lengths of textile material such as woven and knitted fabrics, generally in order to provide an indeterminate length of material for passage through a particular piece of process equipment. A continuous operation obviates the necessity for a roll-by-roll batch operation which is time consuming, and also counter-productive as to efficient operation of state of art processing equipment. Typically, in conjunction with a material accumulator or system, or in an environment where interruption of a processing machine is not critical, operators have historically placed a trailing end of one length of material and a leading end of a next length of material in a juxtaposed arrangement and sewn thereacross to create an appropriate joining seam. Similarly, techniques have also involved the joining of the leading and trailing ends of discrete lengths of material by other means such as heat sealing, and the like.

In each type of joining technique noted above, it is necessary for an operator to first be aware of the time when the production of a seam is necessary, and secondly to be physically present at the machine in order to facilitate manufacture of the joining seam. While in certain circumstances large rolls of material are utilized with seams normally only required once in a relatively prolonged period of time, the arrangement is still problematical. For example, should the material being processed become damaged, it is then necessary for an operator, once learning of the damage, to physically appear at the machine and manipulate the material to repair or remove the damaged portion of the material and to create a further seam thereat.

Typically, a single operator is assigned to a plurality of the processing machines in attempts to minimize labor intensity of the operation. With such an arrangement, should more than one machine assigned to a single operator require seaming at or about the same time, obviously the operator cannot simultaneously handle both assignments at the same time. It then becomes necessary to bring in a further operator, or to shut down one of the machines until such time as a joining seam can be produced. Not only does the machine down time result in lost production, but additionally, judgment of the operator as to whether a particular defect in a fabric should be repaired may be influenced by the operative condition of other machines and/or the willingness of the particular operator to in fact, perform his assigned task.

The present invention overcomes the problems noted above, in that, though an operator is still necessary, a lesser number of operators should be required on a per machine basis, and also the physical presence of the operator at the machine is only required on a very limited basis. Operator presence is normally required to make a judgment as to the necessity of repair of a defect with manufacture of the seam being accomplished automatically. The present invention thus represents significant improvement over prior systems and is not believed to be anticipated or suggested thereby.

SUMMARY OF THE INVENTION

It is an object of the present invention to provide an improved apparatus for the joining of edges of indeterminate lengths of web materials.

Another object of the present invention is to provide an improved apparatus for the automatic formation of a seam between a trailing edge of one length of web material and a leading edge of a next length of web material.

Still further another object of the present invention is to provide an improved apparatus for the automatic seaming of ends of different rolls of textile material to join same.

Another object of the present invention is to provide an improved method for producing a seam between two lengths of web material.

Yet another object of the present invention is to provide an improved method for the seaming of a trailing edge of one roll of textile material to a leading edge of a next roll of textile material automatically and without operator presence.

Generally speaking, the apparatus according to the teachings of the present invention comprises means for supporting and unwinding an indeterminate length of a first roll of web material and for directing said material being unwound along a predetermined path of web travel; means for supporting a second roll of web material adjacent said path of travel of said web material being unwound and for maintaining a leading edge of web from said second roll at a predetermined disposition adjacent said path of travel; means for controlling the unwinding of said first web of material so that as said first web of material is being depleted, a trailing edge of same is located at a predetermined disposition relative to said leading edge of said second roll of material; means for placing said trailing web edge from said first roll of web material into contact with said leading web edge of said second roll of web material at said predetermined location and for maintaining said edges in mutual contact thereat; means for producing a seam across said leading and said trailing edges; and means for moving said second roll of material to the unwind location for said first roll of material, whereby said unwind operation may continue.

More specifically, the apparatus of the present invention includes two roll stations on an unwind stand with surface drive rolls defining a cradle therebetween in a lower portion of each station. The path of travel of the web of a first roll of material being unwound extends rearwardly, adjacent the second roll of material which is first located at a preparation station, and is to be moved to the unwind station once the first roll of material is totally unwound. A manual actuator means is provided for the surface drive rolls of the preparation station such that once a full roll of material is provided thereat, an operator may manually actuate the drive means adequate to rotate the roll being prepared until the leading web edge of same is located. The leading edge is then manually brought into contact atop a web holding means, preferably in the form of a plurality of brushes extending across the width of the web. Certain of the brushes have pins therein for securement of the web. The leading edge of web extends beyond the brushes and is laid atop a sewing support means. Thereafter, upper opposing brushes are moved down into contact with the upper surface of the leading web edge to hold same in place.

Once the trailing edge of the roll being unwound is adjacent and in front of a location where the leading edge of the next web is being maintained, certain of the web holding brushes move outwardly until the two web longitudinal edges are aligned. A web inserter means is then brought into contact with the trailing edge of the web and forces same between the upper and lower holding brushes, locating the trailing web edge atop the leading edge of the next roll. In inserting the trailing web edge, the insertion means deflects the upper brushes rearwardly whereby during retraction of the insertion means the upper bristles hold the trailing web edge in proper location atop the leading web edge. Sewing means may then automatically move across the width of the two webs and trim and sew the webs together forming a junction seam. After the seam is formed, the new roll is transferred from the preparation station to the unwind station, and the operational speed of the unwinding apparatus increases, pulling the joining seam from between the brushes and along the normal path of travel of the web.

The apparatus of the present invention likewise includes a means for removal of an empty tube from a previously unwound web roll. As previously mentioned, the roll is unwound in a cradle formed between two surface drive rolls located beneath same. Consequently upon complete unwinding of the roll, only the core or tube remains in the cradle which continues to rotate along with surface drive rolls. During the unwinding operation and while the roll of web material is supported in the cradle, an idler roll is maintained atop the roll of material to prevent the material roll from jumping out of the cradle, particularly when the diameter of the roll is small, and would otherwise bounce about the cradle. Located on an underside of a support for the top idler roll is a frictional surface, which when brought into contact of an upper surface of the remaining tube or core, causes the tube or core to cease rotation, at which point it is driven out of the cradle by the upstream surface drive roll and deposited on the floor beneath the machine. Thereafter the roll cradle in the preparation area is pivoted upwardly and forwardly and causes the new roll to roll into the area just vacated by the tube. Thereafter, the unwinding operation continues.

Apparatus according to the present invention may be further provided with a defect detection system which determines the location and magnitude of a structural defect in the web being handled. Once a defect is detected and removal is required, a microprocessor which is operatively associated with the machine determines the location of the defect downstream from the detection apparatus and automatically stops the unwind operation, reverses the drive means and returns the defect to a predetermined defect removal location adjacent and above the previously described seaming operation. The web insertion means previously utilized for insertion of a trailing end of web between the holding brushes has been raised to the defect removal means, preferably a second set of brushes. The web insertion means is then actuated to move into contact with a portion of the web where the defect is located and to force a loop of the web thereat between and beyond the second pair of holding brushes. In like fashion the automatic sewing machine is raised to the level of the second brush arrangement and automatically trims the web to remove the defect and forms a new seam thereat. Once the defect has been removed, unwind operation continues, pulling the new seam from between the holding brushes then back through the brushes and along the normal path of travel. Other means may be provided in conjunction with the second brush unit, if necessary, to pull further web material through the brushes.

Generally speaking, the improved method according to teachings of the present invention for automatically joining two rolls of web material comprises the steps of moving a web of material from a first roll located at a first station along a predetermined path for same; locating a second roll of web material at a second station and placing a leading edge of said second web adjacent said path of travel of said first web and securing said leading edge of said second web thereat; locating said trailing edge of said web at a predetermined location adjacent said securement means for said leading edge of web material from said second roll; automatically bringing said trailing edge web material into contact with said leading edge web material from said second roll; joining said leading and trailing edges of material to unite said second roll of material to said first roll of material; transferring said second roll of material to said first location; and moving said web from said second roll along said path.

More particularly, in performance of the method of the present invention, when the second roll of material is placed at the roll preparation area or second location, the operator manually actuates the drive means thereat to locate the leading edge of web, after which the leading web edge is manually brought into contact with a lower web holding means. The operator then enables automatic operation and predetermined sequences are carried out automatically. Thereafter, once the drive means for the first station is interrupted to locate the trailing web edge from the first roll adjacent the web edge holding means, certain of the lower web edge holding means then holding the leading web edge move outwardly to a point where longitudinal edges of the webs are aligned. An upper web holding means then moves downwardly into contact with the surface of said leading web edge, and web insertion means engages said trailing web edge and inserts same atop the leading web edge, between the edge holding means. Once the trailing and leading web edges are properly positioned, an automatic sewing head moves along a path across the width of the web automatically trimming the web and producing a junction seam thereat. Following production of the junction seam, the second roll of web material is then transferred to the roll unwind station, and a further roll of web material is placed in the roll preparation area to be joined to a trailing edge of same at the appropriate time. Also, the drive means for moving the web is reactuated and automatically pulls the joining seam from within the holding means.

The method of the present invention further includes the automatic removal of defects from a moving web comprising the steps of detecting a defect in the moving web, returning the noted defect to a predetermined location; inserting said defected web portion between web holding means, correcting the defect and moving the corrected web along an intended path of travel.

DESCRIPTION OF THE PREFERRED EMBODIMENTS

Figure 1:
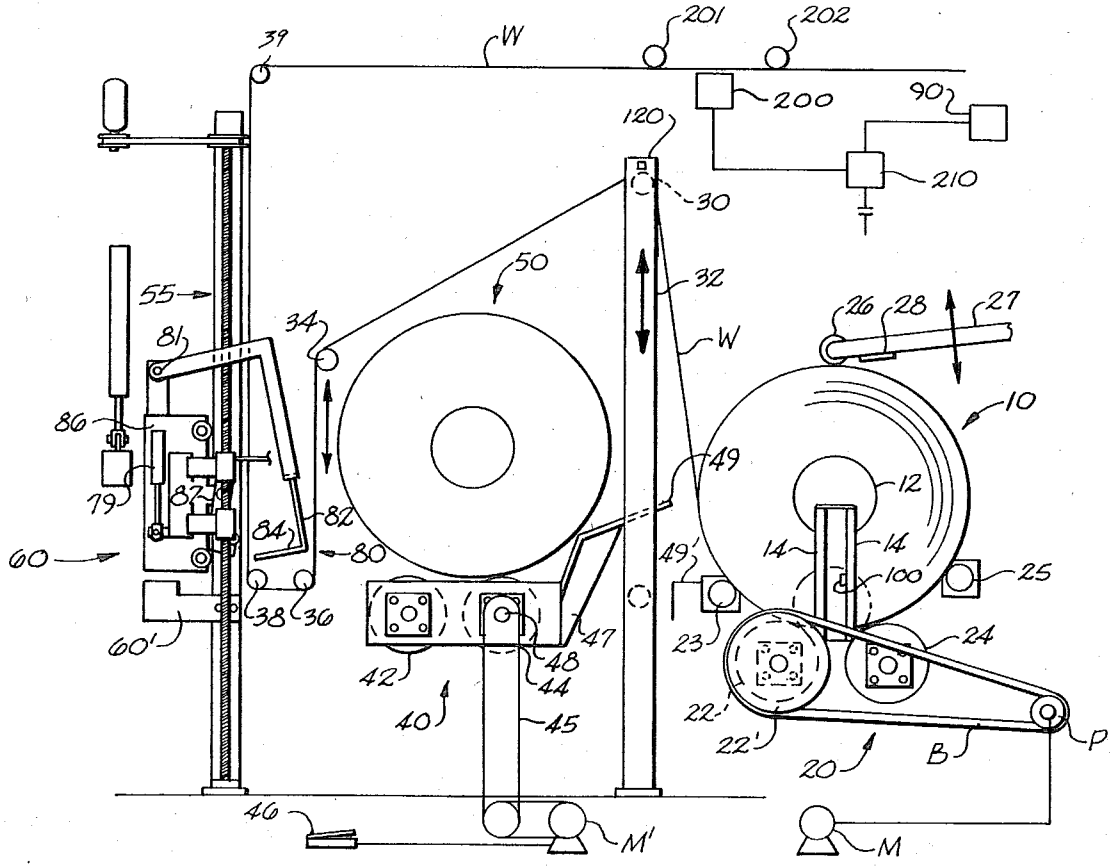
FIG. 1 is an elevational view of a relevant portion of an apparatus according to teachings of the present invention.

Making reference to the Figures, preferred embodiments of the present invention will now be described in detail. FIG. 1 schematically illustrates relevant portions of apparatus according to teachings of the present invention wherein the first roll of materially generally indicated as 10 is located in a web unwind or first station generally indicated as 20 with the web W being unwound therefrom and following a predetermined path of travel to a further piece of processing equipment (not shown). In the sense of the present invention, drive means for forwarding web W beyond the relevant apparatus of the present invention is not illustrated, but may be any conventional drive means for a web, particularly a textile web.

As seen in FIG. 1, web roll 10 is supported on a pair of surface drive rolls 22, 24 with stabilizing idler rolls 23 and 25 located thereabove. Idler rolls 23 and 25 are provided primarily to ensure proper location of roll 10 within the unwind station 20, and once adequate web is unwound from roll 10, rolls 23 and 25 cease to contact the surface of the roll. As schematically illustrated, surface drive roll 22 is associated with a drive pulley P through a belt B or the like, with pulley P being associated with a drive means M. Though not shown, drive roll 22 is interconnected with drive roll 24 to afford a driving motion thereto. Roll 10 is wound around a particular core 12.

As also illustrated in FIG. 1, adjacent unwind station 20, and opposite ends of roll 10 (only one shown) are a pair of vertical standards 14 at opposite ends of roll 10 to assist in maintaining roll 10 at station 20. Further, an additional idler roll 26 is freely rotatably received on a pivoted support means 27, with idler roll 26 resting atop roll 10. Support 27 pivots in the direction of the double headed arrow and thus follows the reducing diameter of roll 10 downwardly to assist in maintaining roll 10 properly in contact with surface drive rolls 22 and 24. Also received on an underside of support 27 is a frictional surface 28, the purpose of which will be described hereinafter.

Web W moving from unwind station 20 moves upwardly and about an idler roll 30 that is received between two vertical standards 32 (only one shown). Idler roll 30 is associated with a chain drive (not shown) and is moved between an upper position as shown in phantom behind standard 32 and a lower roll transfer position as also shown in phantom. Web W then turns downwardly extending around idler rolls 34, 36, 38 and 39 thus defining a path of web travel through the relevant apparatus of the present invention. The path of travel is located adjacent a seam forming station generally indicated as 60 and upwardly therealong, continuing to a next processing unit or the like.

Located immediately adjacent unwind station 20 is a roll preparation station generally indicated as 40 where a new roll of material is deposited onto a cradle defined by bottom surface drive rolls 42 and 44 both of which are driven as is schematically illustrated in FIG. 1 by appropriate pulley drive means generally indicated as 45 powered by motor M' that is operatively connected to a foot pedal 46 or other manipulable switch. Drive rolls 42 and 44 are received for rotation on a framework 47 that is pivotally mounted about a drive shaft 48 for drive roll 44 or some other convenient location. Framework 47 has a roll plate 49 secured thereto which extends angularly outwardly therefrom, the purpose of which will be described hereinafter.

Figure 12:
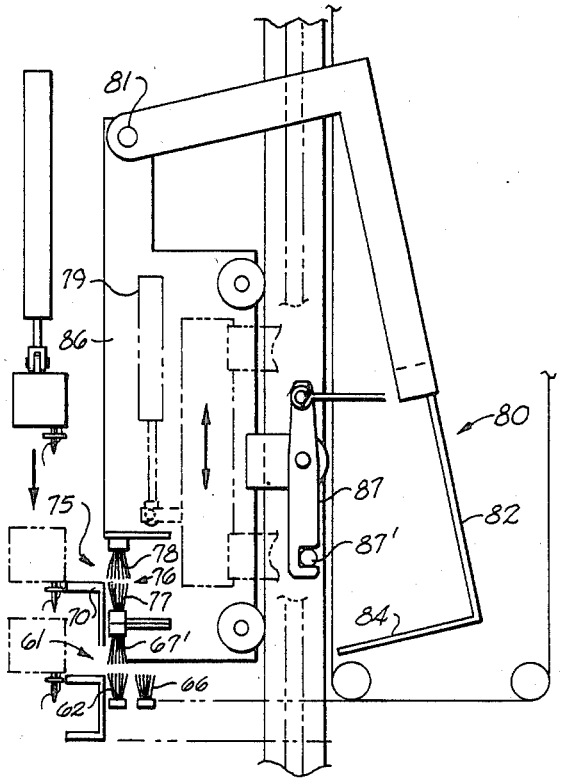
FIG. 12 is an elevational view of a seaming portion of apparatus according to the present invention.

Seam forming station 60 includes a moveable carriage 86 which is received about a drive means generally 55, preferably a screw arrangement for up and down movement therealong. Carriage 86 is raised while a new roll 50 is loaded into preparation station 40 and is then lowered. Carriage 86 is connectable to a base 60' to which lower brushes 62, 64 and 66 are secured by way of locking member 87 and locking pair 87' (See FIG. 12). When disconnected, carriage 86 may be moved independently of base 60'. Likewise brush assembly 75 is moved downwardly by an air cylinder arrangement 79 for a purpose to be described (See FIG. 12).

Figure 2:
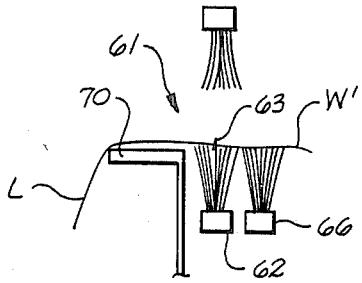
FIG. 2 is a side elevational view of web holding means according to teachings of the present invention illustrating a leading web edge in place.
Figure 3:
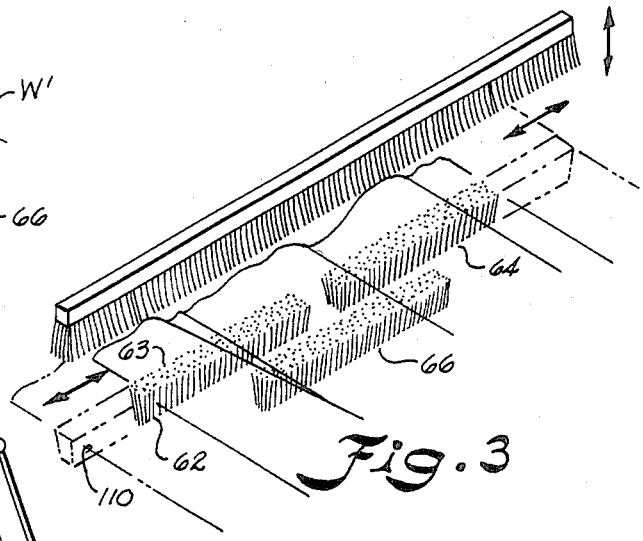
FIG. 3 is an isometric view of a web holding means according to teachings of the present invention.

With roll preparation station 40 empty, and seaming station 60 raised, an operator positions a new roll of material such as a fabric or the like in roll preparation station 40, atop the cradle defined by surface drive rolls 42 and 44. The operator may then depress the foot pedal 46 causing surface drive rolls 42 and 44 to rotate until the leading edge L of the web on roll 50 is located. Station 60 is then lowered and base 60' separated therefrom as noted above. The operator manually pulls the leading edge L into seam forming area 60 (See FIG. 2). Particularly, as is shown in FIGS. 2 and 3, leading edge L of the web W' is pulled beyond a series of brushes 62, 64 and 66 mounted on base 60', which collectively constitute a preferred lower web holding means, and likewise across a sewing support surface 70 with a terminal end of same draping therefrom (See FIGS. 2 and 21) As can be particularly seen in FIGS. 2 and 3, lower web holding brushes 62 and 64 are provided with a plurality of pins 63 which pierce and hold leading edge L of web W'. Brushes 62 and 64 are then located inwardly of their outermost location, shown in solid lines in FIG. 3. Once the second roll 50 of web material is in place and the leading edge L secured atop brushes 62 and 64, the operator depresses an enabling switch 90 which causes an upper web holding brushes 67 of web holding means 61 to move downwardly into contact with an upper surface of leading edge L of web W' (See FIG. 4).

After roll 10 has been unwound to a predetermined point, a sensor schematically indicated as a switch 100 located along a standard 14 is actuated which indicates that the roll 10 is nearly unwound. Actuation of switch 100 then provides input to a control mechanism 210 which reduces the speed of drive elements associated with the apparatus, such as the surface drive rolls 22 and 24 and downstream drive means (not shown) whereby the unwinding speed reduces. Thereafter, as the trailing edge T of web W leaves core 12, it passes about idler rolls 30, 34, 36, and 38 and comes to rest adjacent web holding means 61 (see FIG. 4) when control means 210 stops the operation. Brushes 62 and 64 then move outwardly to the position shown in FIG. 3 in phantom where a sensor schematically illustrated as 110 senses the presence of the outer longitudinal edge of trailing edge T and thereby brings longitudinal edges of leading edge L into alignment therewith.

Figure 4:
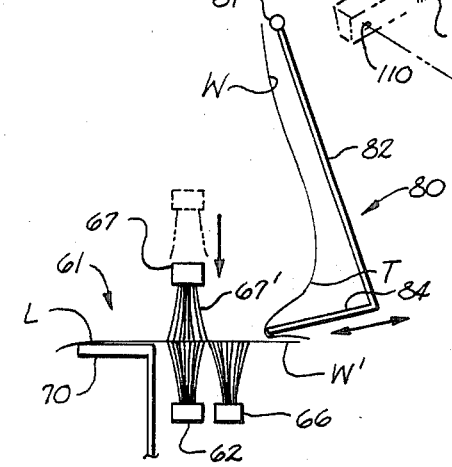
FIGS. 4, 5 and 6 are schematic illustrations of web holding means according to the present invention in a preferred embodiment, illustrating automatic insertion of a trailing web edge therein and the production of a joining seam between trailing and leading web edges.
Figure 5:
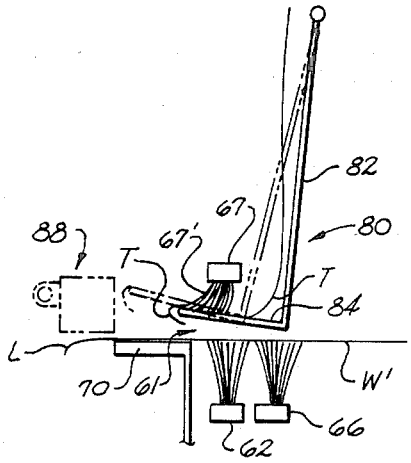
Figure 6:
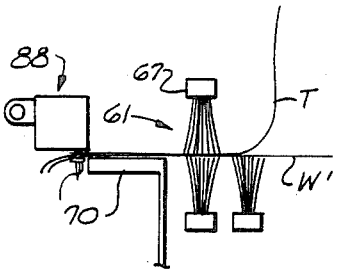

Once longitudinal edges of leading edge L and trailing edge T are in alignment, a web insertion means generally indicated as 80 (see FIG. 4) is actuated and pivotally moves about a pivotal connection 81 into contact with trailing edge T and carries trailing edge T through its pivotal path of travel. Web insertion means 80 is illustrated as an elongated arm 82 having a web pusher finger 84 secured thereto and extending outwardly therefrom. As can be seen in FIGS. 4 and 5, pusher finger 84 moves into contact with bristles 67' of upper brush 67 deforming bristles 67' rearwardly (See FIG. 5). Web insertion means 80 then pivots in the opposite direction with bristles 67' engaging and retaining trailing edge T, whereby trailing edge T is properly located atop leading edge L within the web holding means 61.

Return of web insertion means 80 from within web holding means 61, actuates an automatic sewing head generally indicated as 88 which moves across sewing table 70 (See FIG. 13), trims the outer edges of both leading and trailing edges of webs W and W' respectively, and produces a joining seam therebetween. Once the sewing head 88 completes its path of travel across the width of the respective webs, framework 47 of roll preparation station 40 pivots about pivot point 48, raising surface drive roll 42 against roll 50, and lowers roll plate 49 into contact with plate support 49' (See FIG. 1). Roll 50 then rolls out of the cradle defined by drive rolls 42 and 44 and onto unwind station 20 where it engages idler rolls 25, 23 and self locates atop surface drive rolls 22 and 24.

Figure 13:
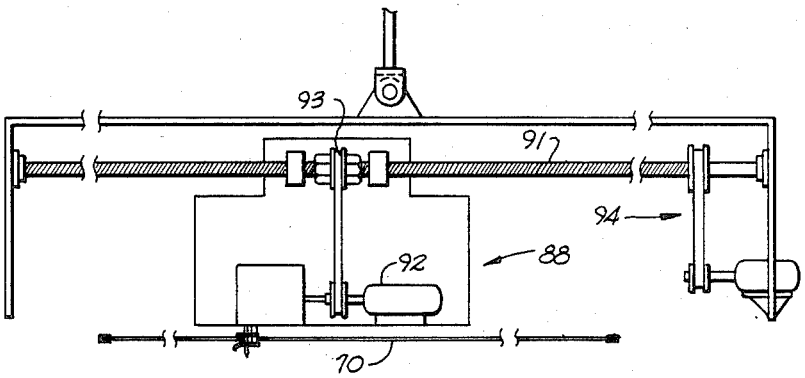
FIG. 13 is a side elevational schematic view of a sewing head for use producing seam according to the present invention.

As illustrated in FIG. 13, sewing head 88 is mounted for movement along a screw 91. Sewing motor 92 rotates a drive member 93 received about screw 91 which effects movement therealong while producing a joining seam. It is desirable to increase stitch density at a fabric selvage. Accordingly, when machine 88 reaches the web selvage area a further drive means generally 94 rotates screw 91 in a direction counter to movement of drive member 93, slowing down the speed of movement of sewing machine 88 thus creating the higher density.

After trailing edge T has passed over idler roll 30 located in its upper position, idler roll 30 is lowered to its lower position, residing beneath the level of roll plate 49 during the roll transfer operation. Thereafter, once roll 50 is located at unwind station 20, idler roll 30 is returned to its uppermost position carrying web W' from roll 50 therewith to redefine the unwind path of web travel.

As idler roll 30 reaches its uppermost position, a sensor schematically indicated as a switch 120 is engaged which signals the control means 210 to return the web drive means to full operational unwind speed. Roll 50 is then unwound.

After roll 50 is located at unwind station 20, framework 47 pivots in the opposite direction, raising plate 49 and lowering drive roll 42, such that drive rolls 42 and 44 resume a proper disposition for receiving yet a further roll of material to be united with the web on roll 50 once same is unwound. In this fashion, an automatic unwinding operation may continue indefinitely without operator influence except for positioning the new roll at roll preparation station 40, manually placing the leading edge L of a web W' within the web holding means 61, and actuating enabling switch 90.

The basic operation of the automatic web joining arrangement having been described above, a further embodiment or adaptation of same will now be described, making reference to FIGS. 1 and 7–9 and 12. As may be seen in FIG. 1, web W after exiting the seam joining area passes by a defect detection device 200 which could be represented by any particular defect detection device that will determine the existence of holes, tears, rips and the like in a moving web. Preferably, defect detection device 200 is of the type as described and claimed in co-pending application, Ser. No. 6,727,284 filed concurrently herewith and entitled APPARATUS AND METHOD FOR DETECTING DEFECTS IN A MOVING WEB, which is incorporated by reference herein. Particularly where a detector 200 determines that a defect has occurred in web W and with detector 200 operatively associated with a control means 210, preferably a microprocessor, once it has been determined that the defect exists, the microprocessor which is programmed for such will reverse the direction of flow of web W and return same to a defect correcting area or upper brush assembly generally indicated as 75 (See FIG. 12) that is located at seaming station 60. Defect correcting area 75 includes a web holding means generally indicated as 76, which preferably is a pair of opposing brushes 77 and 78 of the type discussed with respect to web holding means 61 with the exception that holding pins 63 are not included. Once a defect is detected, seaming station 60 moves downwardly and base 60' and brush assembly 75 are separated from carriage 86. Such separation orients web insertion means 80 for pivotal movement through brushes 77 and 78. With the defect located immediately adjacent defect correcting area 75, a loop of web W is forced between brushes 77 and 78 to reside atop a sewing table 70 as described for production of a joining seam. Automatic sewing machine 88 may then move therealong to trim the defect from web W and to produce a new joining seam thereat.

Once the defect has been removed and the seaming operation is completed, the control means 210 reverses the direction of web feed to its original direction which automatically withdraws the new seam from within the web holding means, and the web follows its normal path of travel.

Figure 7:
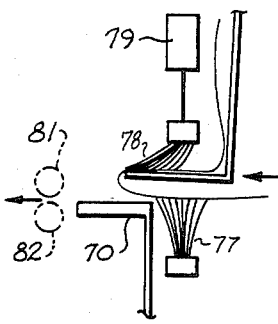
FIGS. 7, 8 and 9 are side elevational schematic views of a second web holding means in a preferred embodiment according to teachings of the present invention illustrating insertion of a web loop therein for the removal of a detected defect.
Figure 8:
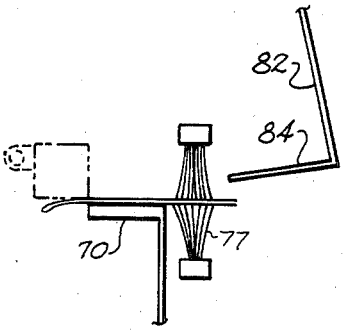
Figure 9:
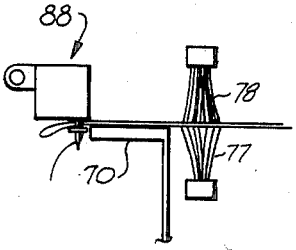
Figure 10:
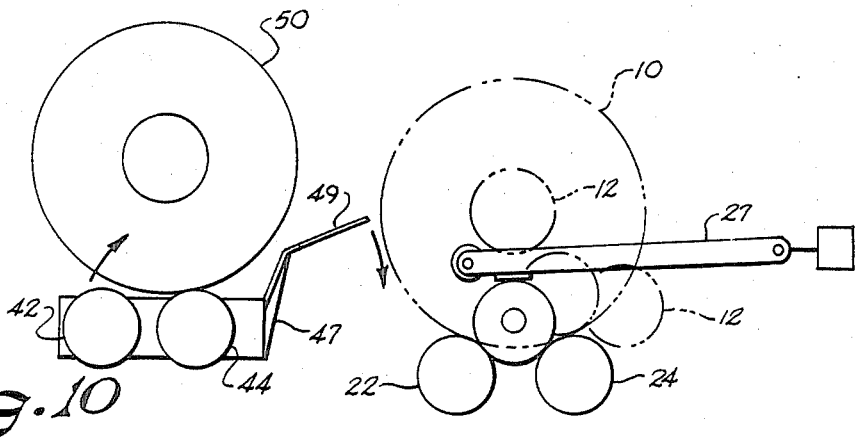
FIGS. 10 and 11 are side elevational schematic illustrations of a relevant portion of the apparatus according to teachings of the present invention illustrating removal of an empty core from a roll unwind station and transfer of a full second roll from a preparation station to the unwind station.
Figure 11:
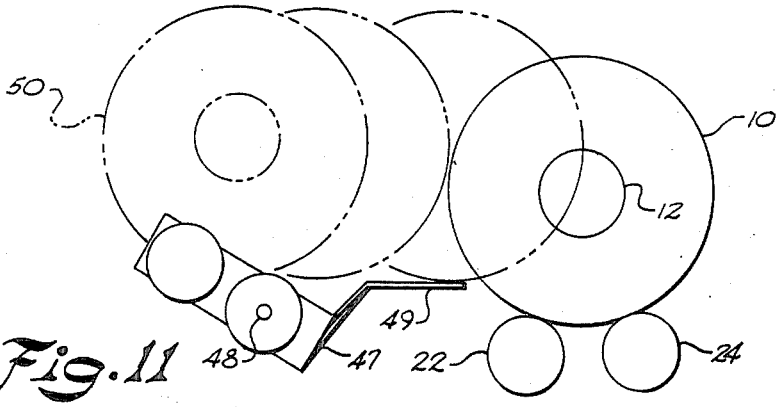

As could be expected, depending upon the size defect detected in the web, the length of same could exceed the length of pusher finger 84 such that when pusher finger 84 positions the web loop between web holding brushes 77 and 78, a portion of the defect still remains outside of the trimming and sewing area. As is shown in FIG. 7, a pair of rolls 81' and 82' are shown in phantom, being located adjacent a terminal end of sewing plate 70. Utilizing the preferred detector system as mentioned above, the microprocessor is informed as to the location and magnitude of the defect. Armed with such information, the program for the microprocessor could incorporate a feature such that when the length of the defect exceeds a predetermined amount, i.e., more than can be inserted in loop form by web insertion element 80, rolls 81' and 82' may be actuated to operate for a predetermined period of time adequate to totally bring the defect beyond the path of the sewing head, such that the entire defect may be trimmed from the web and the new seam formed adjacent thereto.

It will be understood, of course, that while the form of the invention herein shown and described constitutes a preferred embodiment of the invention, it is not intended to illustrate all possible form of the invention. It will also be understood that the words used are words of description rather than of limitation and that various changes may be made without departing from the spirit and scope of the invention herein disclosed.

What is claimed is:

1. Apparatus for joining leading and trailing web edges of two separate webs to form a continuous web length, said apparatus comprising:

(a) means for moving a first web along a predetermined path of travel;

(b) holding means for locating and holding a leading edge of a second web adjacent said path of travel;

(c) means for locating a trailing edge of said first web adjacent said holding means for said leading edge of said second web;

(d) alignment means for automatically aligning longitudinal edges of said second web with longitudinal edges of said first web, said alignment means including means for sensing the position of said first web longitudinal edges, and for transversely positioning said holding means so that said longitudinal alignment results;

(e) means for inserting said trailing edge of said first web within said web holding means, juxtaposed to said leading edge of said second web and with commonly aligned longitudinal edges; and (f) means for joining said leading and trailing edges.

2. Apparatus as defined in claim 1 wherein said first web is provided in roll form at an unwind station, said roll being supported in a cradle defined by a pair of surface drive rolls.

3. Apparatus as defined in claim 2 wherein said second web is provided in roll form and said roll is located at a preparation station and is supported in a cradle defined by a pair of surface drive rolls.

4. Apparatus for joining leading and trailing web edges to form a continuous web length comprising:

(a) means for moving a first web along a predetermined path of travel;

(b) means for locating and holding a leading edge of a second web adjacent said path of travel;

(c) means for locating a trailing edge of said first web adjacent said holding means for said leading web edge;

(d) means for inserting said trailing web edge within said web holding means, juxtaposed to said leading web edge; and (e) means for joining said leading and trailing edges; wherein said first web is provided in roll form at an unwind station, said roll being supported in a cradle defined by a pair of surface drive rolls;

said second web is provided in roll form and said roll is located at a preparation station and is supported in a cradle defined by a pair of surface drive rolls; and said surface drive rolls for said preparation station are mounted on pivotal framework and said preparation station is located adjacent said unwind station, whereby said framework may be pivoted to displace said roll from said preparation station into said unwind station.

5. Apparatus as defined in claim 1 wherein said second web is provided in roll form, said roll being located in a roll preparation station in a cradle defined by a pair of surface drive rolls, and wherein said holding means is located adjacent said preparation station.

6. Apparatus as defined in claim 1 wherein said holding means comprises a plurality of opposing brushes, said brushes holding said web edges therebetween.

7. Apparatus as defined in claim 6 wherein certain of said brushes have web holding pins associated therewith.

8. Apparatus for joining leading and trailing web edges to form a continuous web length comprising:

(a) means for moving a first web along a predetermined path of travel;

(b) means for locating and holding a leading edge of a second web adjacent said path of travel;

(c) means for locating a trailing edge of said first web adjacent said holding means for said leading web edge;

(d) means for inserting said trailing web edge within said web holding means, juxtaposed to said leading web edge; and (e) means for joining said leading and trailing edges; wherein said web holding means comprises a plurality of opposing brushes, said brushes holding said web edges therebetween; and said opposing brushes comprise a plurality of lower brushes, at least certain of said lower brushes having web holding pins therein, and at least certain of said brushes being moveable laterally with respect to said path of web travel, said moveable brushes having sensing means associated therewith whereby said moveable brushes may move outwardly to sense longitudinal edges of said trailing web edge to align same with said leading edge held thereby, and at least one upper brush, said at least one upper brush being moveable toward and away from said lower brushes.

9. Apparatus for joining a plurality of webs comprising:

(a) first brush means, said brush means having bristles extending in a direction to engage a surface of a first web, and being controllably movable transverse to such direction and in the plane of said first web surface for selectively transversely locating such surface;

(b) second brush means located adjacent said first brush means, said second brush means being moveable toward and away from said first brush means and having bristles extending in a direction to engage an opposite surface of said first web;

(c) means to insert a portion of a second web between said brush means when said brush means are immediately adjacent;

(d) sensor means for sensing the presence of longitudinal edges of said second web so that transverse movement of said first bursh means may be controlled for aligning longitudinal edges of said first and second webs; and (e) sewing means located adjacent said brush means and moveable therealong to seam together webs held thereby.

10. Apparatus as in claim 6, wherein:

said opposing brushes comprise a plurality of lower brushes, at least certain of said lower brushes having web holding pins therein, and at least certain of said brushes being moveable laterally with respect to said path of web travel, and further comprising at least one upper brush, said at least one upper brush being moveable toward and away from said lower brushes.

* * * * *